US006935241B2

(12) United States Patent
Hudelmaier et al.

(10) Patent No.: US 6,935,241 B2
(45) Date of Patent: Aug. 30, 2005

(54) METHOD OF PRODUCING A DEVICE CONTAINING PYROTECHNICAL MATERIAL AND DEVICE OBTAINABLE BY THIS METHOD

(75) Inventors: Karl Hudelmaier, Alfdorf (DE); Wolfgang Gabriel, Alfdorf (DE); Thomas Mödinger, Alfdorf (DE)

(73) Assignee: TRW Occupant Restraint Systems GmbH & Co. KG, Alfdorf (DE)

( * ) Notice: Subject to any disclaimer, the term of this patent is extended or adjusted under 35 U.S.C. 154(b) by 0 days.

(21) Appl. No.: 10/440,824

(22) Filed: May 19, 2003

(65) Prior Publication Data

US 2003/0217663 A1 Nov. 27, 2003

(30) Foreign Application Priority Data

May 27, 2002 (DE) ..... 102 23 524

(51) Int. Cl.[7] ..... F42C 11/00

(52) U.S. Cl. ..... 102/202.9; 102/202.5; 102/202.14; 431/362

(58) Field of Search ..... 102/202.5, 202.9, 102/202.14, 530, 531; 431/362

(56) References Cited

U.S. PATENT DOCUMENTS

| | | | | | |
|---|---|---|---|---|---|
| 3,685,947 | A | * | 8/1972 | Meulemans et al. | 431/362 |
| 3,695,179 | A | * | 10/1972 | Rainone et al. | 102/202.11 |
| 4,049,369 | A | * | 9/1977 | Shaffer | 431/362 |
| 4,097,220 | A | * | 6/1978 | Cote et al. | 431/359 |
| 4,174,944 | A | * | 11/1979 | Newell et al. | 431/359 |
| 4,363,622 | A | * | 12/1982 | van Laarhoven | 431/362 |
| 4,696,641 | A | * | 9/1987 | Shaffer et al. | 431/362 |
| 5,022,324 | A | * | 6/1991 | Rice, Jr. | 102/201 |
| 5,844,360 | A | * | 12/1998 | Jeong et al. | 313/495 |
| 5,913,705 | A | * | 6/1999 | Kiesel | 445/27 |
| 6,232,719 | B1 | * | 5/2001 | Kaneko et al. | 313/625 |
| 6,668,726 | B2 | * | 12/2003 | Lussier | 102/307 |
| 2001/0000862 | A1 | * | 5/2001 | Gabriel et al. | 102/202.5 |

FOREIGN PATENT DOCUMENTS

| | | |
|---|---|---|
| DE | 37 02 241 C1 | 6/1996 |
| DE | 298 07 096 U1 | 10/1998 |
| DE | 29807096 | 10/1998 |
| DE | 199 62 146 A1 | 9/2001 |
| EP | 0 952 045 A2 | 10/1999 |

OTHER PUBLICATIONS

U.S. Appl. No. 10/440,824, filed May 19, 2003, entitled "Method of Producing a Device Containing Pyrotechnical Material and Device Obtainable by this Method".

* cited by examiner

*Primary Examiner*—Stephen M. Johnson
(74) *Attorney, Agent, or Firm*—Tarolli, Sundheim, Covell & Tummino L.L.P.

(57) ABSTRACT

A method of producing a device containing pyrotechnical material comprises the following steps: providing a tubular housing element with a base and metal ducts incorporated in the base, with the housing element and the base being integrally formed of glass and the housing element and the base defining a housing interior with a bottom adjoining the base, and the metal ducts extending through the bottom into the housing interior; applying a metal layer on the bottom by forming a heat-generating element integrally connected with the metal ducts and the bottom; introducing the pyrotechnical material into the housing element; and sealing the housing element by heating and melting off. The device obtainable in this way serves for use in vehicle occupant restraint systems, for instance as an igniter in gas generators and belt tensioners.

6 Claims, 2 Drawing Sheets

METHOD OF PRODUCING A DEVICE CONTAINING PYROTECHNICAL MATERIAL AND DEVICE OBTAINABLE BY THIS METHOD

TECHNICAL FIELD

This invention relates to a method of producing a device containing pyrotechnical material for use in a vehicle occupant restraint system. Furthermore, the invention relates to a device obtainable by this method.

BACKGROUND OF THE INVENTION

Devices containing pyrotechnical material for use in a vehicle occupant restraint system are used for instance as gas generators or ignition means in gas bag modules and belt tensioner systems. The ignition means generally comprise a housing, a heat-generating element accommodated therein, such as a heating wire, and pyrotechnical material for generating gas and/or hot particles. The heat-generating element can receive an electric impulse via two wire pins, whereby it is heated abruptly and ignites the pyrotechnical material. A membrane sealing the housing is usually burst thereby, and the ignition of the gas-generating charge of an air bag gas generator or a tensioning means is activated.

Since the requirements on the reliability during activation of such ignition means are very high, the production thereof generally involves a rather high effort. Care should be taken in particular that the electric connection between the heat-generating element and the wire pins is formed reliably and that the heat-generating element lies in the housing of the ignition means in a mechanically stable way.

With the device containing pyrotechnical material, which comprises a housing made of glass surrounding the pyrotechnical material, as it is described in German Utility Model DE 298 07 096, a gas- and liquid-tight ignition means was provided.

BRIEF SUMMARY OF THE INVENTION

The present invention provides a method of producing a device containing pyrotechnical material, by means of which on the one hand a safe and stable arrangement of the heat-generating element is achieved and which on the other hand can be produced at very low cost. The method according to the invention comprises the following steps:

- providing a tubular housing element with a base and metal ducts incorporated in the base, with the housing element and the base being integrally formed of glass and the housing element and the base defining a housing interior with a bottom adjoining the base, and the metal ducts extending through the bottom into the interior;
- applying a metal layer on the bottom by forming a heat-generating element integrally connected with the metal ducts and the bottom;
- introducing the pyrotechnical material into the housing element; and
- sealing the housing element by heating and melting off.

Optionally, the metal layer can undergo a secondary treatment by thermal or mechanical methods for adjusting the desired properties of the heat-generating element.

In particular, the application of the metal layer can be effected by vapor-deposition of metal on the bottom by forming the metal layer, and the metal layer can be removed to a layer thickness and width defining the heat-generating element. This is particularly advantageous, as on the one hand the vapor-deposition of metal on the bottom results in a particularly intimate connection of the metal layer with the bottom and with the metal ducts arranged in the bottom. Further method steps for attaching the heat-generating element to the metal ducts or the bottom, e.g. by gluing or bonding, can then be omitted. On the other hand, the electric properties of the finally obtained heat-generating element, such as the electric resistance, can be adjusted very precisely by removing the metal layer.

In another particularly preferred embodiment, the application of the metal layer is effected by applying metal powder to the bottom, preferably in the form of a viscous mass, and the formation of the heat-generating element is achieved by melting the metal powder. On the one hand, the thickness of the heat-generating element can be adjusted very precisely by a predetermined amount of metal powder, and on the other hand the melting of the metal powder results in a particularly intimate connection of the heat-generating element with the metal ducts provided in the bottom. Particularly preferably, the metal powder has an average particle size between 0.1 and 10 $\mu$m. As a result, the amount of metal powder required can be adjusted very precisely, and a good connection of the metal powder with the bottom can be achieved.

The invention also comprises a device containing pyrotechnical material for use in vehicle occupant restraint systems, as it can be obtained by employing the method of the invention. In particular, the device can be an igniter for a gas generator in gas bag modules or belt tensioners.

DETAILED DESCRIPTION OF THE PREFERRED EMBODIMENT

Figure 1:
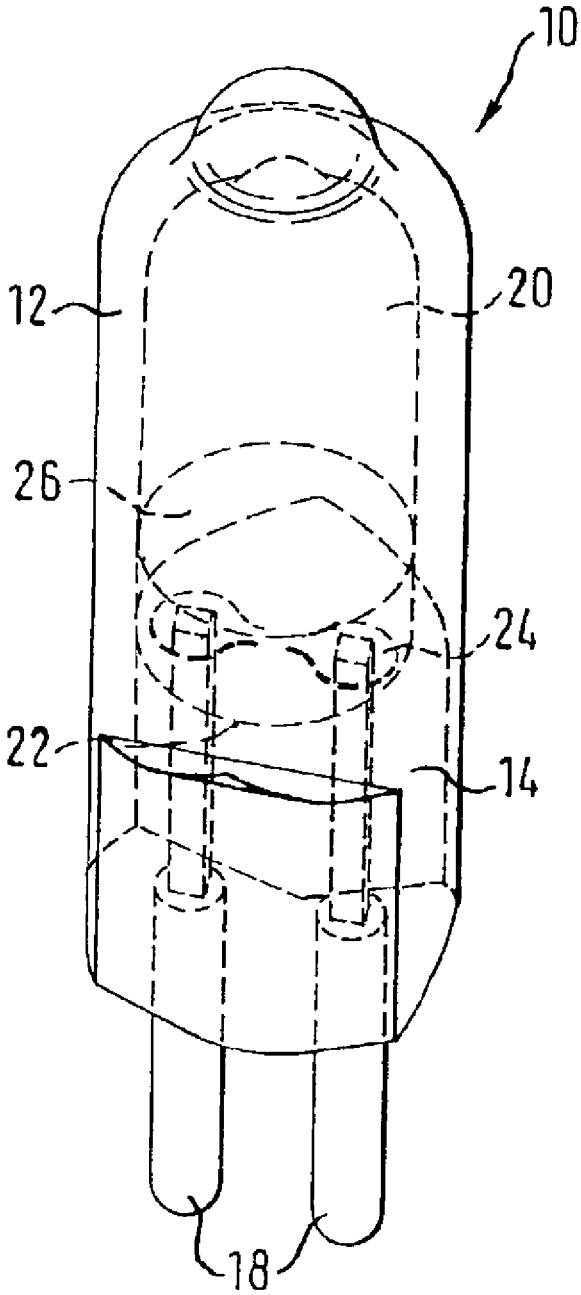
FIG. 1 shows a perspective view of a device containing pyrotechnical material, which can be obtained by the method of the invention, for use in vehicle occupant restraint systems.
Figure 2A:
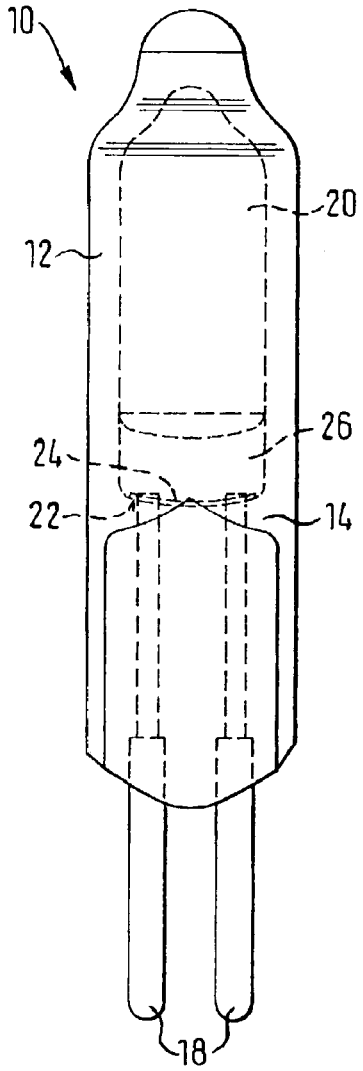
FIGS. 2*a* and 2*b* show sectional views of the device in accordance with the invention as shown in FIG. 1.
Figure 2B:
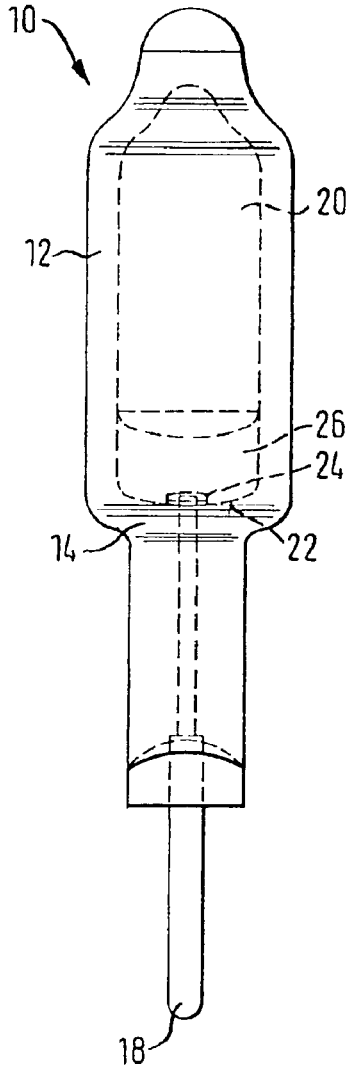

The Figures show a device 10 containing pyrotechnical material for use in a vehicle occupant restraint system. The device 10 comprises a tubular housing element 12 with a base 14, which are both made of glass and are formed integrally. At the upper end, the housing element 12 is molten off. In the vicinity of the base 14, two metal ducts 18 extend, which by pressing the glass base heated until softening onto the metal ducts have been incorporated in the same in a gas- and liquid-tight way and extend into the interior 20 of the housing element 12. On a bottom 22 adjoining the base 14 towards the interior 20, a heat-generating element 24 is disposed. As can be seen in FIG. 2*a*, the heat-generating element 24 constitutes a thin metal layer which substantially extends over the entire width of the bottom 22 and is integrally connected therewith. Above the bottom 22, the metal ducts 18 are integrally connected with the heat-generating element 24 in an electrically conductive way. As a result of their manufacture, the metal ducts can slightly protrude beyond the heat-generating element 24 into the interior 20 of the housing element 12. Between the metal ducts 18, the metal layer of the heat-generating element 24 is tapered, so that the element is abruptly heated when current passes through it. Directly above the heat-generating element 24, the pyrotechnical material 26 is disposed, which can be in direct contact with the heat-generating element 24 and can comprise a primary charge and a booster charge such as $B/KNO_3$, which is a mixture of Boron and potassium nitrate.

In the following, the method of producing the device containing pyrotechnical material for use in a vehicle occupant restraint system should be represented in detail in a preferred embodiment.

First of all, the tubular housing element 12 is provided, which is integrally formed of glass with the base 14 and includes metal ducts 18 mounted in the base in a gas- and liquid-tight way. Such component can be obtained prefabricated, for instance from the production of halogen lamps. The housing element 12 first of all is open towards the top. Metal is then applied to the bottom 22 from the open side of the housing element 12. Basically all methods which provide for the production of metal coatings by deposition of metal on a surface can be used for this purpose. Particularly useful is high-vacuum evaporation, which provides for a specific, directionally precise application of metal onto a predetermined surface. Moreover, the amount of metal to be evaporated and thus the layer thickness of the heat-generating element 24 can already be defined in advance. In another step, the metal layer is removed to a defined layer thickness and form by an abrasive method, which can either be of a thermal or of a mechanical nature, whereby the predetermined electric properties of the heat-generating element, such as the electric resistance and thus the amount of heat released with a defined current impulse in a certain region of the heat-generating element 24, can be achieved particularly accurately. Thereafter, the pyrotechnical material 26 is introduced into the housing element 12 in liquid or solid form. What is preferred is the introduction in the form of a solution or slurry and subsequent evaporation of the solvent. The pyrotechnical charge can have a uniform composition or be composed in a known manner of a primary and a secondary charge or a booster charge. Finally, the housing element is sealed gas- and liquid-tight by melting, for instance by means of a laser, on the first still open side.

In another preferred embodiment of the method, metal powder is introduced into the provided tubular housing element 12 from above onto the bottom 22, and subsequently the metal powder is molten by supplying heat, whereby the heat-generating element 24 is formed. The metal powder can be applied in the form of a slurry or possibly with a viscous mass containing a binder. In this method, too, the heat-generating element 24 lies flat on the bottom 22 of the base 14 and is integrally connected with the bottom in a mechanically particularly stable way. The melting of the metal powder also leads to an integral connection between the heat-generating element 24 and the metal ducts 18, whereby a good electric contact between these components is achieved. If necessary, another thermal or mechanical secondary treatment of the heat-generating element 24 thus formed is performed to adjust the desired properties. Sealing the housing element 12 is effected in the same way as in the first described embodiment of the method, preferably by melting off by means of a laser.

If an electric voltage is applied to the metal ducts 18, for instance by a current impulse triggered by an acceleration sensor as a result of a vehicle accident, a sudden heating of the heat-generating element 24 occurs, which transmits the thermal energy to the pyrotechnical material 26. Thereupon, the pyrotechnical material 26 is ignited, and hot particles and hot gases are released, which effect an increase in pressure in the interior 20 of the housing element 12. This increase in pressure finally leads to a bursting of the housing element 12, whereby the hot gases and the particles are released and ignite the pyrotechnical charge of a gas generator or belt tensioner.

What is claimed is:

1. A method of producing a device containing pyrotechnical material adapted for use in an occupant restraint system in a vehicle, the method comprising the following steps:

providing a tubular housing element with a base and metal ducts incorporated in said base, with said housing element and said base being integrally formed of glass and said housing element and said base defining a housing interior with a bottom adjoining said base, and said metal ducts extending through said bottom into said housing interior;

applying a solid metal layer on said bottom, wherein the solid metal layer is connected with said metal ducts thereby interconnecting said metal ducts and forming a heat-generating element;

introducing a quantity of said pyrotechnical material into said housing element, said quantity of pyrotechnic material being sufficient to provide enough energy to burst said housing upon ignition of said pyrotechnic material; and sealing said housing element by heating and melting off.

2. The method of producing a device as claimed in claim 1, wherein the step of applying said metal layer on said bottom includes vapor deposition of metal to form said solid metal layer, and removing metal from said metal layer to a layer thickness and layer width defining said heat-generating element.

3. The method of producing a device as claimed in claim 1, wherein the step of applying said solid metal layer includes applying a metal powder to said bottom; and melting said metal powder to form said heat-generating element.

4. The method of producing a device as claimed in claim 3, wherein said metal powder has a mean particle size of between 0.1 and 10 $\mu$m.

5. A device containing pyrotechnical material and adapted for use in an occupant restraint system in a vehicle, wherein the device is obtainable by a method comprising the following steps:

providing a tubular housing element with a base and metal ducts incorporated in said base, with said housing element and said base being integrally formed of glass and said housing element and said base defining a housing interior with a bottom adjoining said base, and said metal ducts extending through said bottom into said housing interior;

applying a solid metal layer on said bottom, wherein the solid metal layer is connected with said metal ducts thereby interconnecting said metal ducts and forming a heat-generating element, said step of applying said solid metal layer on said bottom includes vapor deposition of metal to form said solid metal layer;

introducing said pyrotechnical material into said housing element; and sealing said housing element by heating and melting off.

6. The device containing pyrotechnical material as claimed in claim 5, wherein said device is an igniter for a gas generator or a belt tensioner.

* * * * *